US007677866B2

(12) United States Patent
Bromann

(10) Patent No.: US 7,677,866 B2
(45) Date of Patent: Mar. 16, 2010

(54) DEVICE FOR ADJUSTING THE CENTRING OF A TURBO-ENGINE PIVOTING VANE CONTROL SYNCHRONIZATION RING

(75) Inventor: Alain Marc Lucien Bromann, Vulaines/Seine (FR)

(73) Assignee: SNECMA, Paris (FR)

( * ) Notice: Subject to any disclaimer, the term of this patent is extended or adjusted under 35 U.S.C. 154(b) by 574 days.

(21) Appl. No.: 11/670,530

(22) Filed: Feb. 2, 2007

(65) Prior Publication Data

US 2007/0183889 A1 Aug. 9, 2007

(30) Foreign Application Priority Data

Feb. 9, 2006 (FR) ..... 0650461

(51) Int. Cl.
*F01D 17/12* (2006.01)

(52) U.S. Cl. ..... 415/160

(58) Field of Classification Search ..... 415/148, 415/149.4, 150, 151, 155, 159, 60, 162, 166, 415/173.2, 189, 190
See application file for complete search history.

(56) References Cited

U.S. PATENT DOCUMENTS 4,299,534 A * 11/1981 Yamane et al. ..... 415/9
4,925,364 A * 5/1990 Das ..... 415/150
5,288,206 A * 2/1994 Bromann et al. ..... 415/209.2
5,387,080 A * 2/1995 Bouhennicha et al. ..... 415/150
6,092,984 A * 7/2000 Bouyer ..... 415/119
7,244,098 B2 * 7/2007 Bromann ..... 415/160

FOREIGN PATENT DOCUMENTS

EP 1 403 467 A2 3/2004
WO WO 2005/045202 A1 5/2005

* cited by examiner

*Primary Examiner*—Edward Look
*Assistant Examiner*—Ryan H Ellis
(74) *Attorney, Agent, or Firm*—Oblon, Spivak, McClelland, Maier & Neustadt, L.L.P.

(57) ABSTRACT

The invention relates to a device for adjusting the centring of a turbo-engine pivoting vane control ring, comprising a control ring (26) centred on a longitudinal axis (X-X) of the turbo-engine and provided with a plurality of tapped holes (36) running in a radial direction and a plurality of pad holders (32), each comprising a threaded rod (34) screwed into one of the ring's tapped holes (36), each pad holder (32) holding, at an inner end, a pad (30) intended to come into contact with a cylindrical shell (28), coaxial with the ring. The control ring (26) comprises, in addition, a plurality of slots (38) running in a tangential direction, each slot (38) communicating with one of the ring's tapped holes (36) The device comprises means (40, 42*a*, 42*b*) of pinching, in a longitudinal direction, each of the slots (38) in such a way as to lock the pad holders (32) in position.

5 Claims, 3 Drawing Sheets

DEVICE FOR ADJUSTING THE CENTRING OF A TURBO-ENGINE PIVOTING VANE CONTROL SYNCHRONIZATION RING

BACKGROUND OF THE INVENTION

This invention relates to the general area of devices for adjusting the centring of a ring for synchronization of control of pivoting vanes of a turbo-engine on the latter's axis.

In a turbo-engine, it is a known practice to use one or several stages of stator vanes for adjusting the flow and direction of flow of the gases going through the compression section in accordance with the operating conditions of the turbo-engine. These stages of stator vanes comprise a plurality of vanes (called variable pitch vanes) which may pivot about their pins connecting them to the stator in such a way as to alter their pitch angle in accordance with the operating conditions of the turbo-engine.

The known devices for controlling variable pitch vanes usually comprise a ring surrounding a cylindrical shell of the turbo-engine casing and a plurality of levers or connecting rods, each connecting rod having a first end coupled to the control ring by a joint and a second end fitted to the pivot of the respective vane. The synchronized alteration of the angular position of the vanes is thus achieved by rotation of the ring about the turbo-engine axis.

The vane control ring is centred on the turbo-engine axis. In addition, it is arranged coaxially with the shell of the casing of the turbo-engine and generally rests on the latter by means of a plurality of pads, evenly distributed along its full circumference.

In order to improve the precision of stator vane pitch, it is necessary to seek to ensure excellent concentricity of the control ring with the casing shell. Perfect concentricity can be obtained by maintaining a very small clearance between the pads and the casing shell. To obtain a very small clearance, the devices used for fitting the pads to the control ring must therefore make it possible for the pads to be adjusted in a radial direction.

Devices for adjusting control ring concentricity generally use pads fitted to threaded rods which are screwed into the control ring. Also, from document U.S. Pat. No. 5,387,080, pads are known, the radial position of which is adjusted by means of a double screw which is fitted to the ring and the two portions of which have slightly different helix angles.

These devices for adjusting the pads in the control ring are not capable of providing perfect immobilization of the pad adjustment threaded rod during all the operating phases of the turbo-engine. In fact, when some pads are no longer in contact with the casing shell, wear of the adjustment rod threads is caused by vibration, which leads to loss of adjustment of the pads and consequently vibration of the control ring, this vibration being particularly detrimental in terms of vane pitch precision.

OBJECT AND SUMMARY OF THE INVENTION

The principal object of this invention is to mitigate these drawbacks by proposing a device for adjusting control ring concentricity which is simple in design and reliable during all the phases of turbo-engine operation.

This object is achieved due to a device for adjusting the centring of a turbo-engine pivoting vane control ring, comprising a control ring centred on a longitudinal axis of the turbo-engine and provided with a plurality of tapped holes running in a radial direction and a plurality of pad holders, each comprising a threaded rod screwed into one of the ring's tapped holes, each pad holder holding, at an inner end, a pad intended to come into contact with a cylindrical shell coaxial with the ring and in which, in accordance with the invention, the control ring comprises, in addition, a plurality of slots running in a tangential direction and going through the ring radially, each slot communicating with one of the ring's tapped holes and the device comprises means of pinching, in a longitudinal direction, each of the slots in such a way as to lock the pad holders in position.

The pads are adjusted in the radial direction by screwing the threaded rod more or less into the control ring. Once the correct adjustment has been carried out, the pad holder rod is locked in position by pinching the slot in a longitudinal direction. Therefore, this adjusting device comprises few parts, which makes it simple in design and is capable of providing reliable locking of the pads, irrespective of the phase of turbo-engine operation.

In accordance with a preferred embodiment of the invention, the control ring comprises, in addition, a plurality of holes running in a longitudinal direction, each hole communicating with one of the ring's slots and the device comprises a plurality of bolt-connection systems, each inserted in one of the holes in the ring in such a way as to effect pinching, in a longitudinal direction, of the corresponding slot.

Advantageously, each slot runs, at one of its tangential ends, into one of the tapped holes of the control ring. In this case, each slot can run, at its tangential end opposite the tapped hole, into a smooth bore going through the control ring radially.

Another object of this invention is a turbo-engine comprising at least one device for adjusting the centring of a pivoting vane control ring as defined above.

BRIEF DESCRIPTION OF THE DRAWINGS

Other features and advantages of this invention will be evident from the description given below, with reference to the attached drawings, which illustrate an example of the embodiment of the said invention, without any limiting nature. Concerning the illustrations, FIG. 1 schematically shows a stage of pivoting vanes with a control ring.

DETAILED DESCRIPTION OF AN EMBODIMENT

Figure 1:
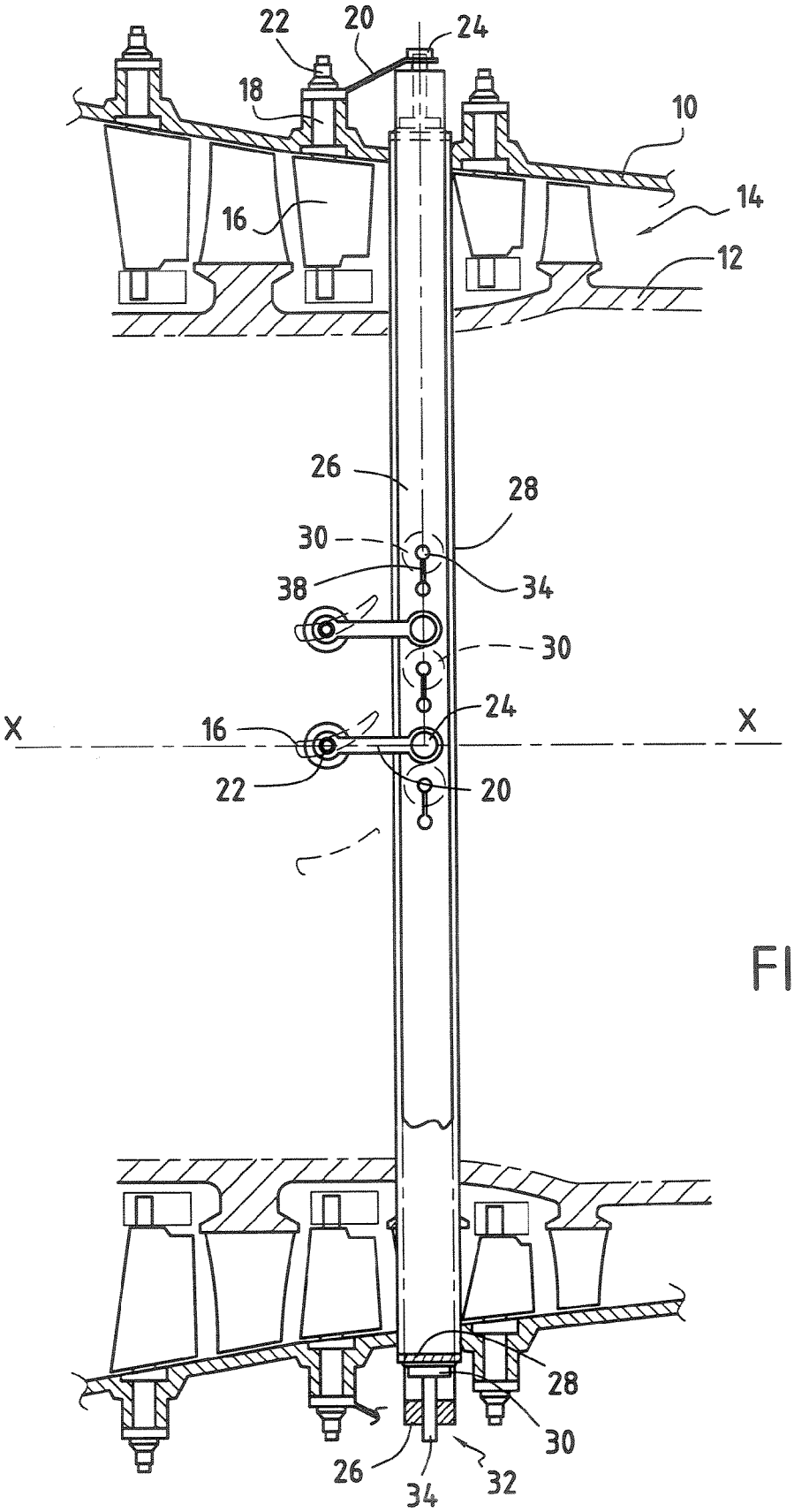
Figure 2:
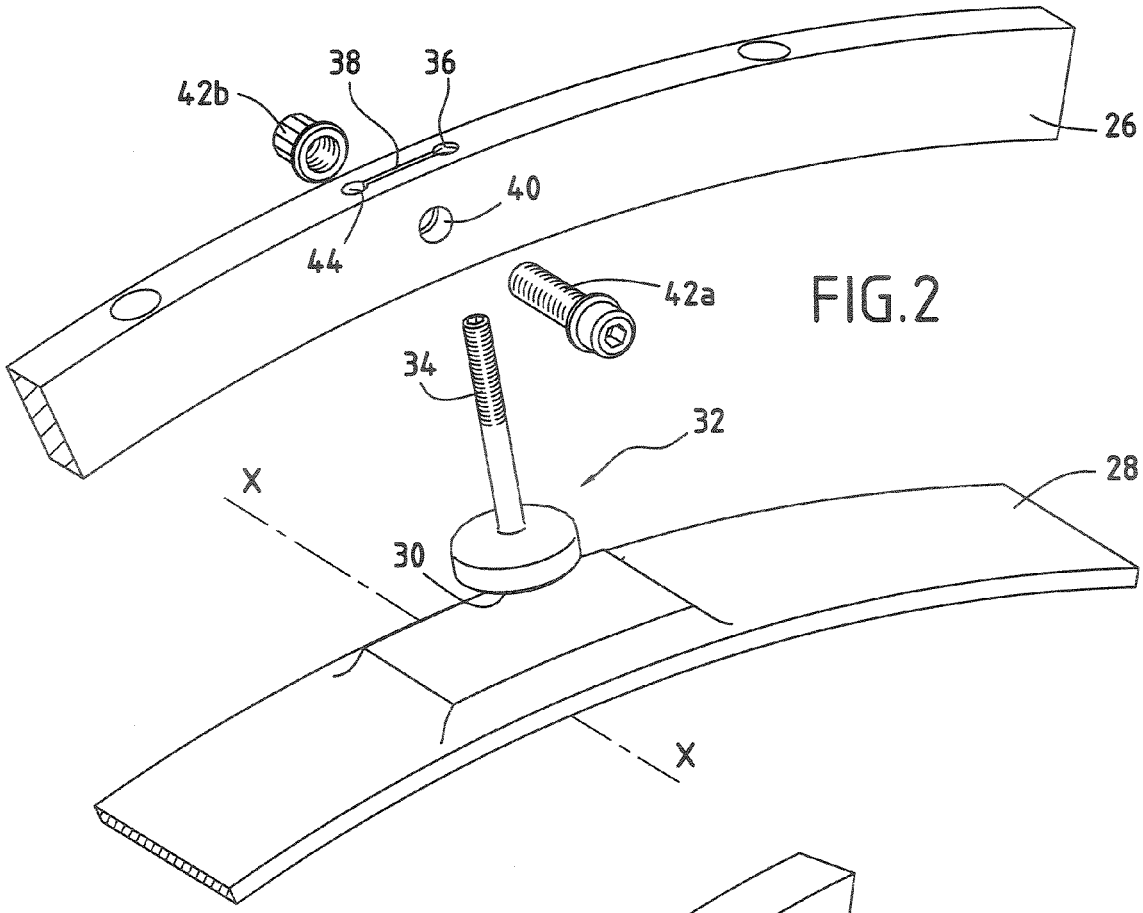
FIG. 2 is a perspective view of the adjusting device in accordance with the invention before its assembly.

FIG. 1 partially shows a turbo-engine compressor. The compressor comprises a stator shell 10 which is centred on longitudinal axis X-X of the turbo-engine and which surrounds a rotor 12 in such a way as to define with the latter an annular stream 14 for flow of the gases.

The compressor also comprises a plurality of vanes which form several stages in the stream 14. Some of these stages are formed by variable pitch vanes 16. These vanes 16 pivot about a radial pin 18 which goes through the stator shell 10.

Each pin (or pivot) 18 of the variable pitch vanes 16 is connected to one end of a connecting rod or control lever 20 via a connector 22. The other end of the connecting rods 20 is articulated about pins 24 arranged radially on a control ring 26. The latter surrounds a cylindrical shell 28 of the casing of the turbo-engine, which is centred on the longitudinal axis X-X of the latter. The control ring 26 and the cylindrical shell 28 are arranged concentrically with each other.

The invention relates to a device with which it is possible to adjust the centring of the control ring 26 in relation to the longitudinal axis X-X of the turbo-engine. More precisely, such a device is capable of maintaining a fixed radial spacing between the control ring 26 and the cylindrical shell 28 of the turbo-engine casing.

As illustrated in FIGS. 2 to 5, the device for adjusting the centring of the control ring 26 in accordance with the invention comprises, in particular, a plurality of pads 30 intended to come into contact with the cylindrical shell 28 of the turbo-engine casing.

The pads 30 are evenly distributed over the whole circumference of the control ring 26 and are, for example, arranged between two adjacent pins 24 (FIG. 1).

Figure 3:
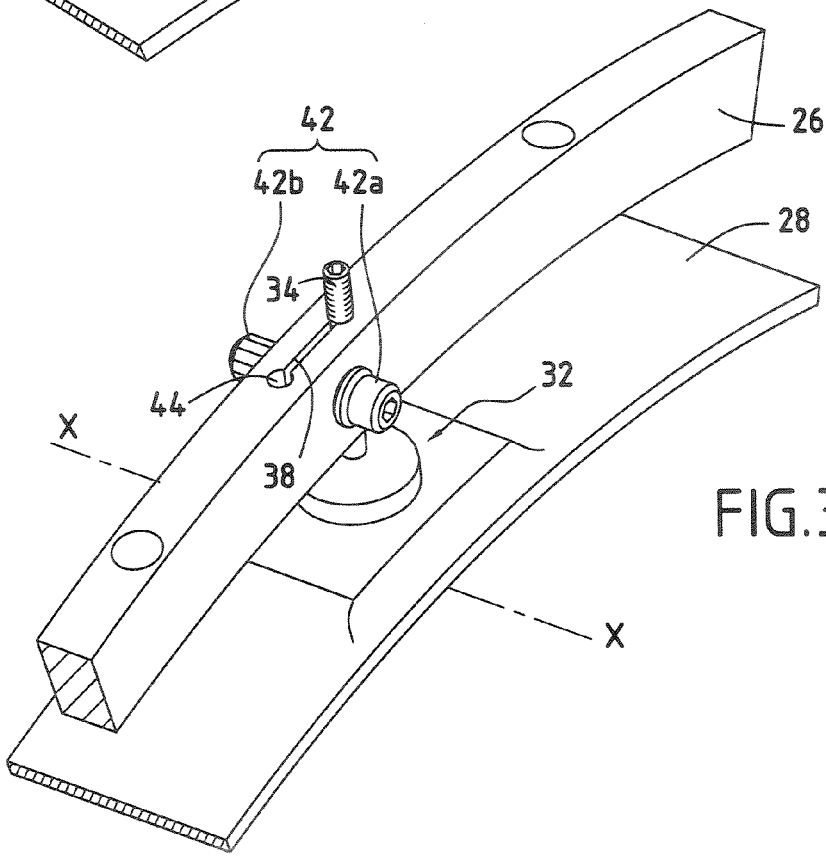
FIG. 3 is a perspective view of the device in FIG. 2 after its assembly and FIGS. 4 and 5 are cutaway views of the device in FIG. 3, in a longitudinal plane and radial plane, respectively.
Figure 5:
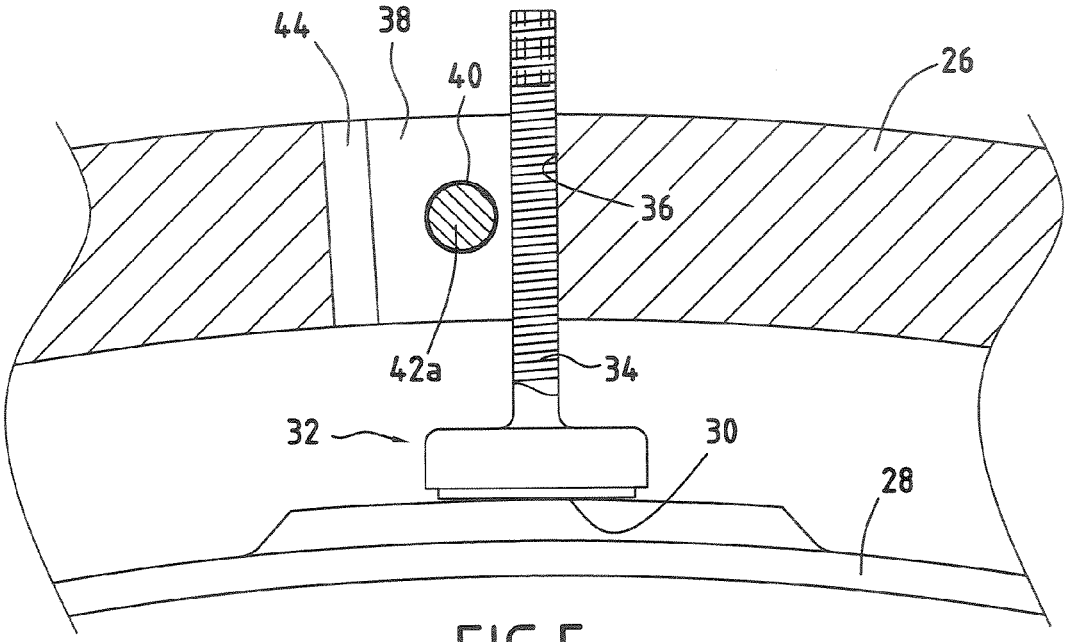

Each pad 30 is rigidly locked with an inner end of a pad holder 32 on which it is, for example, crimped. Each pad holder 32 is made up of a threaded rod 34 which is screwed into a tapped hole 36 running right through the control ring 26 and running in a radial direction in relation to the latter. Once it has been screwed into the control ring, the rod 34 of the pad holders 32 protrudes radially beyond the ring (FIGS. 3 and 5).

In accordance with the invention, the control ring 26 comprises, in addition, a plurality of slots 38 which run in a tangential (or circumferential) direction of the ring and which go right through the ring radially. Furthermore, each slot 38 communicates with one of the tapped holes 36 in the ring.

In the example of the embodiment in FIGS. 2 to 5, the communication between the slots and the tapped holes in the control ring is effected by the fact that each slot 38 runs, at one of its tangential ends, into the corresponding tapped hole 36 of the ring.

The device for adjusting the centring of the control ring 26 in accordance with the invention comprises, in addition, means of pinching, in a longitudinal direction, each of the slots 38 in such a way as to lock the pad holders 32 in position.

In order to do this, the control ring 26 comprises a plurality of holes 40 (which are smooth for example) running in a longitudinal direction (i.e. parallel with the longitudinal axis X-X of the turbo-engine) and each communicating with one of the slots 38 in the ring.

Figure 4:
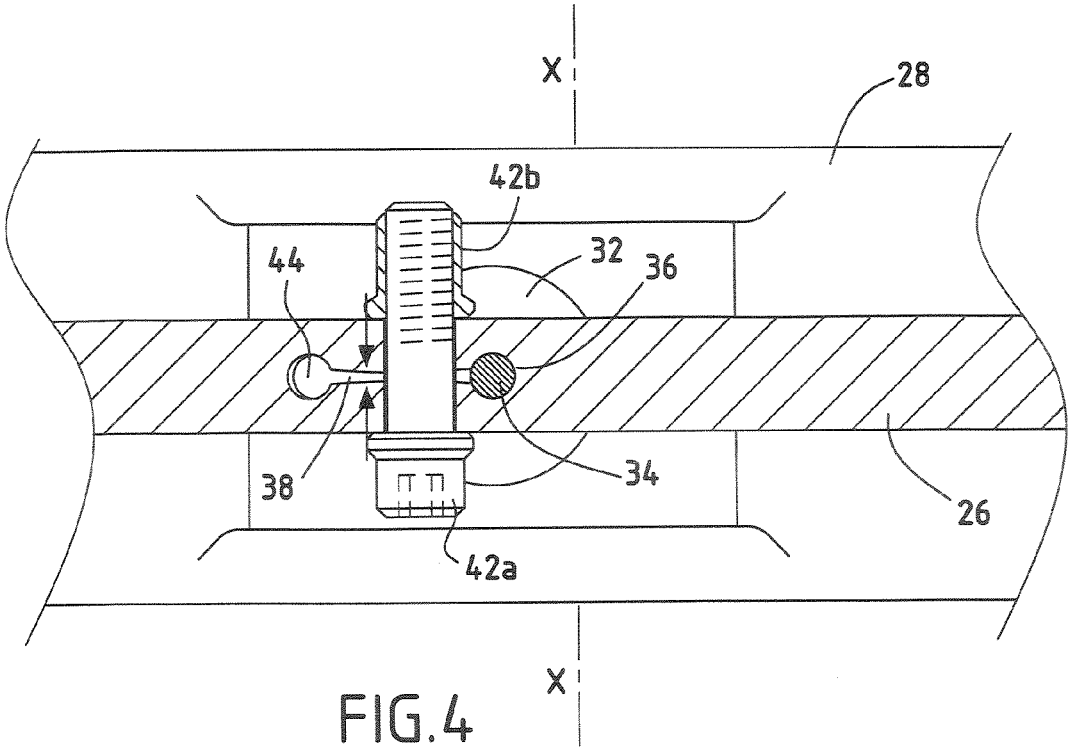

In the example of the embodiment in FIGS. 2 to 5, the communication between the slots and the holes in the control ring is effected by the fact that, as shown in FIG. 4, each hole 40 goes right through one of the slots 38, substantially perpendicularly to the latter.

The device comprises, in addition, a plurality of bolt-connection systems 42 which are each screwed together through one of the holes 40 in the ring, each bolt-connection system 42 being made up of a bolt 42*a* and an adjusting nut 42*b*.

By tightening the nut 42*b* on the bolt 42*a* inserted in one of the holes 40, pinching, in a longitudinal direction, of the corresponding slot 38 is effected (in other words, the slot 38 has a tendency to deform, as shown by the arrows in FIG. 4). Such pinching of the slot thus makes it possible to lock the corresponding pad holder 32 in position. With this type of device, it is thus not necessary to provide a nut tightened on the free end of the threaded rod.

It will be noted that, the closer the hole 40, in which the bolt 42*a* is inserted, is situated (in a tangential direction) to the tapped hole 36, in which the threaded rod 34 of the corresponding pad holder is screwed, the greater the pinching effect and therefore the stronger the locking of the pad holder in position.

It will also be noted that each slot 38 can run, at its tangential end opposite the tapped hole 36 for threaded rod 34 to pass through, into a smooth bore 44 going right through the control ring 26 radially. The function of these smooth bores 44 is to make the machining of the slots 38 possible (in fact, the tool for machining the slots must be capable of running into the two tangential ends of the slots).

The adjustment of the radial position of each pad 30 relative to the cylindrical shell 28 is effected by screwing the threaded rod 34 of the pad holder 32 more or less into the corresponding tapped hole 36 of the control ring 26. When the optimum position of the pad 30 is obtained, the bolt 42*a* is inserted in the corresponding hole 40 and the nut 42*b* is tightened on the free end of the bolt in such a way as to lock the pad holder 32 in its optimum position by pinching. By carrying out this adjustment for each pad fitted to the control ring, it is then possible to centre the latter on the longitudinal axis X-X of the turbo-engine.

The invention claimed is:

1. A device for adjusting the centring of a turbo-engine pivoting vane control ring, comprising;

a control ring centred on a longitudinal axis of the turbo-engine and provided with a plurality of tapped holes running in a radial direction of the control ring and a plurality of pad holders, each of the plurality of pad holders comprising a threaded rod screwed into one of the tapped holes of the control ring, each pad holder holding, at an inner end, a pad intended to come into contact with a cylindrical shell coaxial with the control ring, wherein the control ring comprises, in addition, a plurality of slots running in a tangential direction and going through the control ring radially, each slot communicating with one of the tapped holes of the control ring and wherein the device comprises means of pinching, in a longitudinal direction, each of the slots in such a way as to lock the pad holders in position.

2. A device according to claim 1, wherein the control ring comprises, in addition, a plurality of holes running in a longitudinal direction of the control ring, each hole communicating with one of the slots of the control ring and wherein the device comprises a plurality of bolt-connection systems, each inserted in one of the holes in the control ring in such a way as to effect pinching, in the longitudinal direction of the control ring, of a corresponding one of the plurality of slots.

3. A device according to claim 1 wherein each slot runs, at a tangential end of the respective slot, into one of the tapped holes of the control ring.

4. A device according to claim 3, wherein each slot runs, at a tangential end opposite the tapped hole, into a smooth bore that extends through the control ring radially.

5. A turbo-engine, comprising; at least one device for adjusting the centring of a pivoting vane control ring according to any one of claims 1 to 4.

* * * * *